United States Patent [19]

Nakayoshi et al.

[11] Patent Number: 4,968,233

[45] Date of Patent: Nov. 6, 1990

[54] HYDRAULIC GEAR MOTOR

[75] Inventors: Hideki Nakayoshi, Kariya; Naoyuki Iwase, Nishio, both of Japan

[73] Assignee: Aisin Seiki Kabushiki Kaisha, Kariya, Japan

[21] Appl. No.: 329,859

[22] Filed: Mar. 28, 1989

[30] Foreign Application Priority Data

Mar. 28, 1988 [JP] Japan ..... 63-73969

[51] Int. Cl.[5] ..... F04C 2/10; F04C 13/00

[52] U.S. Cl. ..... 418/77; 418/78; 418/166

[58] Field of Search ..... 418/77, 78, 166, 171

[56] References Cited

U.S. PATENT DOCUMENTS

| | | | |
|---|---|---|---|
| 3,722,329 | 3/1973 | Van Hecke et al. | 418/166 X |
| 3,824,047 | 7/1974 | McDermott | 418/171 |
| 3,834,842 | 9/1974 | Dorff et al. | 418/171 X |
| 4,361,419 | 11/1982 | Vohringer | 418/171 X |

FOREIGN PATENT DOCUMENTS

| | | | |
|---|---|---|---|
| 113191 | 5/1988 | Japan | 418/166 |
| 2002453 | 2/1979 | United Kingdom | 418/166 |

*Primary Examiner*—Michael Koczo
*Assistant Examiner*—Douglas J. Makosy
*Attorney, Agent, or Firm*—Oblon, Spivak, McClelland, Maier & Neustadt

[57] ABSTRACT

A gear motor includes a housing provided with a cylindrical opening therein. A cover covers the opening of the housing to form an enclosed chamber. A shaft is rotatably supported on the cover and housing. An outer tooth gear is axially movably mounted on the shaft and integrally rotatable with the shaft. An inner tooth gear meshes with the outer tooth gear to form actuating chambers. An inlet port is formed on the cover for introducing a high pressure fluid to the actuating chambers. An outlet port is formed on the cover for discharging the fluid from actuating chambers. High and low pressure ports are provided in both the cover and housing. The outer circumferential portion of the high pressure port of housing is larger in radius than that of the high pressure port of the cover.

3 Claims, 3 Drawing Sheets

HYDRAULIC GEAR MOTOR

BACKGROUND OF THE INVENTION

1. Field of the Invention:

This invention relates to a gear motor and more particularly to a hydraulic gear motor used for driving a ventilator by rotating in response to actuation by a high pressure actuating oil from an oil pump.

2. Description of the Related Art:

A conventional gear motor of this type is, for example, disclosed in Japanese Patent Laid Open No. 62 (1987) - 276274. There, the gear motor is provided with a housing having inlet and outlet ports for the fluid, an inner tooth gear rotatably disposed within the housing and forming actuating chambers therein, an outer tooth gear disposed within the inner gear and forming the above-mentioned actuating chambers together with the inner tooth gear, a shaft integrally rotated with the outer tooth gear, a bearing rotatably supporting the shaft, and inlet and outlet ports communicating with the actuating chambers. A brake which can be contacted with the inner tooth gear is slidably disposed in the housing and an electromagnetic coil is provided for displacing the brake shoe.

However, a port is not formed at a housing side of the gears. As a result, the outer and inner tooth gears are pressed toward the housing side by oil pressure, a clearance between the cover and the tooth gears oil becomes large and the leakage amount of the high pressure oil increases. That is, the tooth gears are contacted with the housing side by the oil pressure, so that the oil does not flow into a clearance between the housing and the gears. The oil film between the housing and the gears is thus eliminated and the sliding resistance becomes large. The motor cannot be rotated (oil lock state) when the sliding resistance becomes larger than the torque generated by the motor.

SUMMARY OF THE INVENTION

It is therefore an object of the present invention to provide a gear motor in which drawbacks according to the prior art can be eliminated.

It is further object of the present invention to provide a gear motor in which an improvement in efficiency of a gear motor and the prevention of the oil lock can be attained.

According to the present invention, a gear motor includes a housing having an a cylindrical opening therein, a cover provided for covering the opening end of the housing to form an enclosed chamber, a shaft rotatably supported on the cover and the housing, an outer tooth gear axially movably disposed on the shaft and integrally rotated with the shaft, an inner tooth gear meshing with an outer circumference of the outer tooth gear and forming at least one actuating chamber together with the outer tooth gear, a fluid inlet port in the cover and providing a high pressure fluid to the actuating chambers, an outlet port in the cover and receiving a fluid from the actuating chamber, high pressure ports in the cover and housing, low pressure ports in the cover and housing, and an outer circumferential portion of the high pressure port on the housing side being larger in radius than that of the high pressure port on the cover side.

As a further feature, an oil groove communicates with the high pressure port on the cover side from the radially outer end of the high pressure port of the housing via the outer circumference of the inner tooth gear.

As a further feature, a gear portion of at least one of the gears is much thinner than a boss portion thereof.

BRIEF DESCRIPTION OF THE DRAWINGS

The foregoing and other objects, features and advantages of the present invention will be understood more clearly and fully from the following detailed description of preferred embodiments with reference to the attached drawings.

DETAILED DESCRIPTION OF THE PREFERRED EMBODIMENTS

Figure 1:
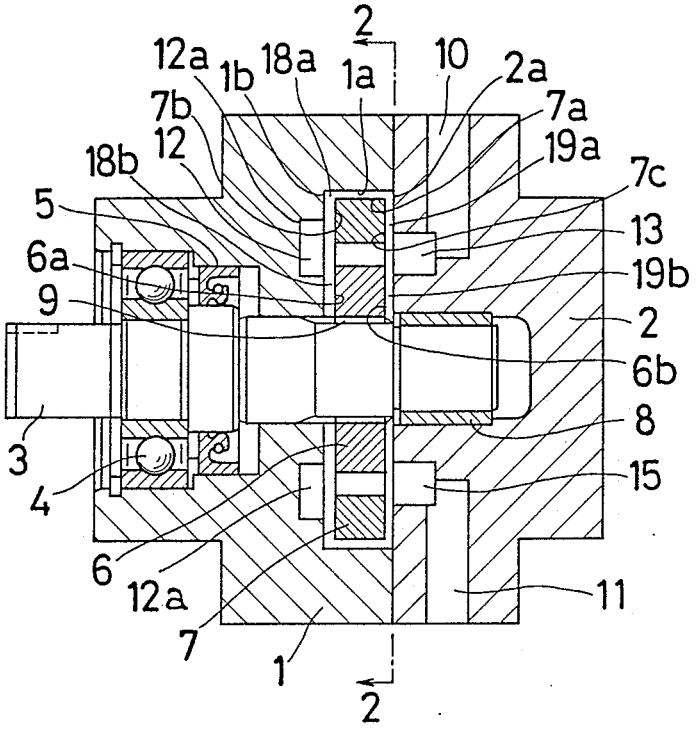
FIG. 1 is a vertical cross sectional view of first embodiment according to the present invention.
Figure 2:
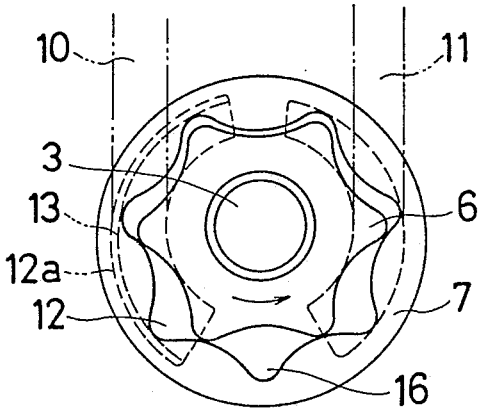
FIG. 2 is a cross sectional view through 2—2 in FIG. 1.

Referring to FIGS. 1, 2 showing a first embodiment according to the present invention, a gear motor is located at a cylindrical end opening of a cylindrical housing 1. An opening portion of the housing 1 is covered by a cover 2 to form an enclosed chamber. An inner tooth gear 7 having a ring shape is rotatably positioned in the enclosed chamber, and an outer tooth gear 6 is fitted within the inner tooth gear such that the teeth of the inner and outer tooth gears mesh with one another. The outer tooth gear 6 is splined on a spline portion 9 of a shaft 3 rotatably supported by a ball bearing 4 disposed in the housing 1. A metal bush or a needle bearing 8 having a ring shape is rotatably inserted into a bore of the cover 2 and rotatably supports an end of the shaft 3. The outer tooth gear 6 is axially movable on the shaft 3 but rotates therewith. A brake for the inner tooth gear, such as that in Japanese Patent Laid Open No. 62-276274 is also provided, but is not shown. An oil seal 5 in the housing is contacted with an outer circumferential portion of the shaft 3, so that an actuating oil is prevented from flowing outward.

The cover 2 is provided with inlet and outlet ports 10, 11 for the fluid to be pumped. A high pressure port 13 in the cover 2 communicates with the inlet port 10 and a low pressure port 15 in the cover 2 communicates with the outlet port 11. Actuating chambers 16 are interposed between the inner and outer tooth gears 7, 6 and oil can be transmitted from the inlet port 10 to the actuating chambers 16 via the high pressure port 13. The oil from the actuating chambers 16 is transmitted via the low pressure port 15 in the cover to the outlet port 11. Thus, a plurality of actuating chambers 16 are formed between inner and outer tooth gears 7, 6 and a high pressure actuating oil is introduced into the actuating chambers 16 via the inlet port 10 and high pressure port 13, as a result of which the inner tooth gears 6, 7 are rotated in the arrow direction shown in FIG. 2 by the pressure difference between inlet and outlet ports 10, 11 while oil within the actuating chambers 16 escapes to the low pressure outlet port 11 via the low pressure port 15.

As above-mentioned, the outer tooth gear 6 is integrally rotated with the shaft 3. The other end of the shaft 3 is projected from the housing 1 to drive, for example, a ventilator. The inner tooth gear 7 faces an inner circumferential portion 1*a* of the housing 1 at an outer circumferential portion 7*a* of the inner tooth gear 7. A lateral portion 1*b* of the housing 1 faces a lateral portion 7*b* of the inner tooth gear 7, and a lateral portion 2*a* of the cover 2 faces other lateral portion 7*c* of the inner tooth gear 7, all with a suitable clearance. The high pressure oil introduced from the inlet port 10 is supplied to the low pressure port 15 through the high pressure port 13 formed in the cover 2 and the actuating chambers 16, and a partial high pressure oil is supplied from the high pressure port 13 to the clearance 19*a* between the lateral portion 7*c* of the inner tooth gear 7 and the lateral portion 2*a* of the cover 2, and to the clearance 19*b* between a lateral portion 6*b* of the outer tooth gear 6 and a lateral portion 2*a* of the cover 2, and then to the clearance 18*a* between a lateral portion 7*b* of the inner tooth gear 7 and the lateral portion 1*b* of the housing 1, and the clearance 18*b* between a lateral portion 6*a* of the outer tooth gear 6 and the lateral portion 1*b* of the housing 1. Accordingly, a suitable oil film can be formed.

When the high pressure oil flows to inner and outer tooth gears 7, 6 from the high pressure port 13 in the cover, inner and outer tooth gears 7, 6 are pressed toward the housing 1 and the clearances 18*a*, 18*b* become small while the clearances 19*a*, 19*b* become large. Accordingly, high and low pressure ports 12 and 12A are formed in the housing. The outer circumference 12*a* of the high pressure port 12 is larger in radius than that of the high pressure port 13 formed on the cover 2. As a result, the inner tooth gear 7 is pressed towards the cover 2 by the oil pressure from the high and low pressure ports 12 and 12A formed in the housing 1, so that a suitable clearance is maintained and the motor can be moved.

Figure 3:
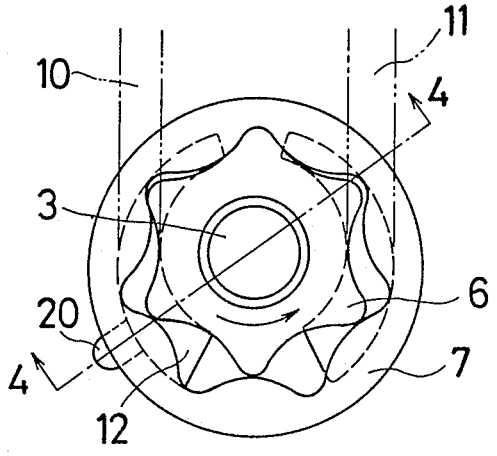
FIG. 3 is an axial end view of a second embodiment according to the present invention.
Figure 4:
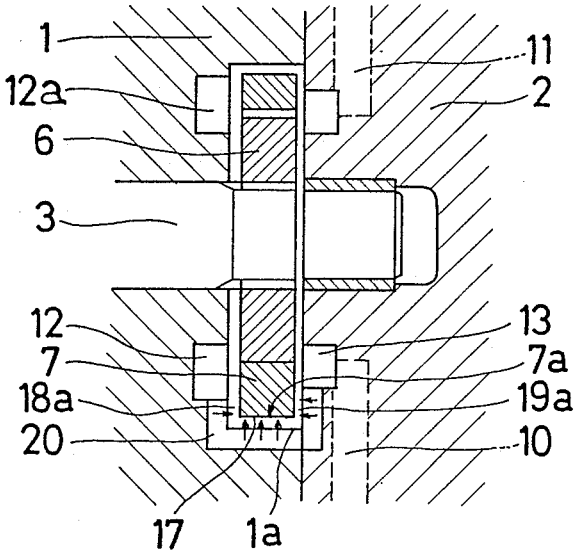
FIG. 4 is a cross sectional view through 4—4 in FIG. 3.

Referring now to FIGS. 3, 4 showing a second embodiment of the present invention, an oil groove 20 is provided and is extended in said housing and said cover from the high pressure port 12 within the housing 1 to the inner circumferential portion 1*a* of the housing 1 and is communicated with the high pressure port 13 of the cover 2 via the inner circumferential portion of the housing 1. Therefore, the oil can be surely supplied to a clearance 18*a* between the inner tooth gear 7 and the housing 1, a clearance 19*a* between the inner tooth gear 7 and the cover 2, and a clearance 17 between the outer circumferential portion 7*a* of the inner tooth gear 7 and the inner circumferential portion 1*a* of the housing 1. A suitable oil film can thus be formed and smooth operation can be attained.

Figure 5:
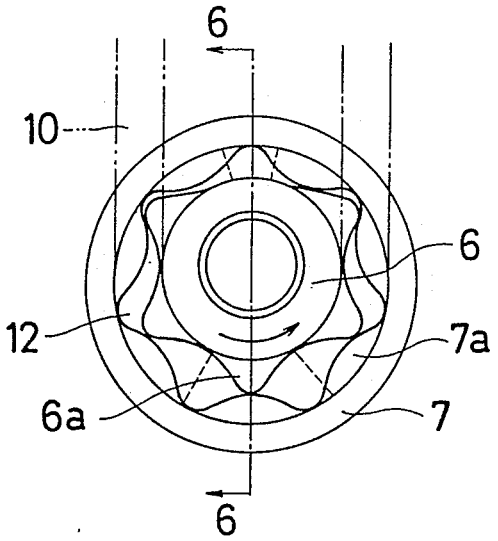
FIG. 5 is a view similar to FIG. 3, but showing a third embodiment according to the present invention.
Figure 6:
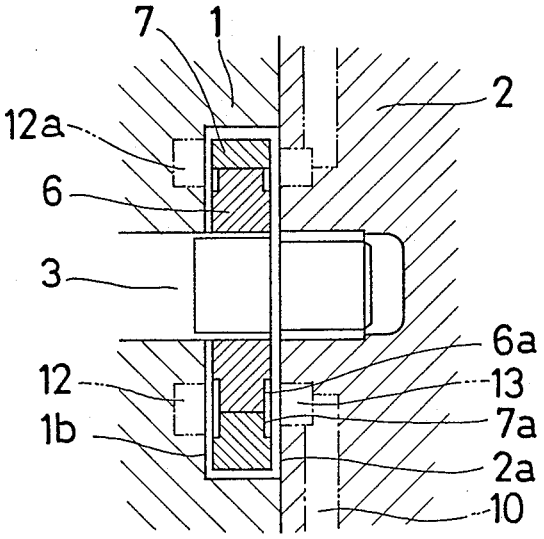
FIG. 6 is a cross sectional view through 6—6 in FIG. 5.

Next referring to FIGS. 5, 6 showing a third embodiment of the present invention, the tooth portions 7*a*, 6*a* of inner and outer tooth gears 7, 6 are slightly thinner than the width of a boss portions of inner and outer tooth gears 7, 6, so that smooth driving can be attained without contact of the teeth with the lateral portion 1*b* of the housing 1 and the lateral portion 2*a* of the cover 2, even if the inner and outer tooth gears 7, 6 are inclined due to an imbalance of the oil pressure.

In the above-mentioned three embodiments, a suitable clearance is maintained at all of the clearances 17, 18*a*, 18*b*, 19*a*, and 19*b* between the inner tooth gear 7, the outer tooth gear 6, the housing 1, and the cover 2, so that the leakage amount of the high pressure oil from the high pressure port 13 to the low pressure port 15 is small. Further, the inner and outer tooth gears 7, 6 are kept in a floating state by an oil film, so that the sliding resistance is decreased and the efficiency of the motor can be improved.

The principles, preferred embodiment and modes of operation of the present invention have been described in the foregoing application. The invention which is intended to be protected herein should not, however, be constructed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is new and desired to be secured by Letters Patent of the United States is:

1. A gear motor comprising:

a housing provided with a cylindrical opening at one end thereof;

a cover provided for covering said opening of said housing so as to form an enclosed chamber;

a shaft rotatably supported on said cover and housing and extending through said enclosed chamber;

an outer tooth gear in said enclosed chamber, said outer tooth gear being axially movably mounted on said shaft and integrally rotatable with said shaft;

an inner tooth gear in said enclosed chamber and meshing with said outer tooth gear for forming at least one actuating chamber together with said outer tooth gear;

inlet port means formed in said cover for providing a high pressure fluid;

outlet port means formed in said cover for receiving a low pressure fluid;

high pressure ports provided in said housing and said cover, said high pressure port in said cover being axially opposite said high pressure port in said housing and comprising means for communicating said inlet port means with said at least one actuating chamber;

low pressure ports provided in said housing and said cover axially opposite one another for communicating said at least one actuating chamber with said outlet port means;

wherein an outer circumferential portion of said high pressure port in said housing is larger in radius than said high pressure port in said cover, whereby said inner and outer tooth gears are movable in said enclosed chamber.

2. A gear motor as set forth in claim 1, further comprising an oil groove extending in said housing and said cover from said high pressure port in said housing to said high pressure port in said cover via an outer circumferential portion of said inner tooth gear.

3. A gear motor as set forth in claim 1, wherein an axial thickness of tooth portions of at least one of said inner and outer tooth gears is less than that of boss portions of said gears.

* * * * *